US009192835B1

(12) United States Patent
Goserud

(10) Patent No.: US 9,192,835 B1
(45) Date of Patent: Nov. 24, 2015

(54) DEVICE FOR SECURING GOLF TEES AND BALL MARKS

(71) Applicant: J. Thomas Goserud, Landisville, PA (US)

(72) Inventor: J. Thomas Goserud, Landisville, PA (US)

( * ) Notice: Subject to any disclaimer, the term of this patent is extended or adjusted under 35 U.S.C. 154(b) by 0 days.

(21) Appl. No.: 14/121,303

(22) Filed: Aug. 18, 2014

Related U.S. Application Data

(63) Continuation-in-part of application No. 13/987,704, filed on Aug. 23, 2013, now Pat. No. 8,810,345.

(51) Int. Cl.
*H01F 7/00* (2006.01)
*A63B 57/00* (2015.01)

(52) U.S. Cl.
CPC ..... *A63B 57/0031* (2013.01); *A63B 57/0075* (2013.01)

(58) Field of Classification Search
CPC ..... H01F 7/0252; H01F 7/02; H01F 7/04; H01F 7/0205; H01F 7/0231; H01F 7/0236; H01F 7/0273; H01F 7/0284; H01F 7/0294; H01F 27/365; H01F 3/10
USPC ..... 335/219
See application file for complete search history.

(56) References Cited

U.S. PATENT DOCUMENTS 1,703,138 A * 2/1929 Falcone ..... A63B 57/0031 2/250
1,754,495 A * 4/1930 Anderson ..... A63B 57/0031 206/315.9
5,109,172 A * 4/1992 Pace ..... H02K 23/04 310/154.43
5,172,839 A * 12/1992 Frisbie ..... A63B 57/0031 224/251
5,364,094 A * 11/1994 Mustion ..... A63B 57/0075 224/183
5,641,064 A * 6/1997 Goserud ..... B65D 39/16 206/315.1
5,782,708 A * 7/1998 Kimball, Jr. ..... A63B 57/0068 224/918
5,813,529 A * 9/1998 Goserud ..... B65D 39/16 206/315.1
D401,149 S * 11/1998 Goserud ..... D9/439
D402,888 S * 12/1998 Goserud ..... D9/439
D409,486 S * 5/1999 Goserud ..... D9/434
6,244,464 B1 * 6/2001 Goserud ..... B43M 99/009 221/155
D447,052 S * 8/2001 Goserud ..... D9/418
D466,041 S * 11/2002 Goserud ..... D11/79
D474,826 S * 5/2003 Goserud ..... D21/796
D476,053 S * 6/2003 Goserud ..... D21/789
6,988,646 B2 * 1/2006 White ..... A63B 55/008 206/315.1
D538,874 S * 3/2007 Ceruti ..... D21/796
D567,320 S * 4/2008 Pelosi ..... D21/796
D618,298 S * 6/2010 Adams ..... D21/796
D666,411 S * 9/2012 Goserud ..... D3/221
D674,454 S * 1/2013 ÅSberg ..... D21/796
8,684,867 B2 * 4/2014 Murphy ..... A63B 57/0031 224/918

* cited by examiner

*Primary Examiner* — Shawki S Ismail
*Assistant Examiner* — Lisa Homza
(74) *Attorney, Agent, or Firm* — Norman Rainer

(57) ABSTRACT

A device for retrieving and securing golf tees and ball marks while providing several modes of motion of the secured ball mark employs a frame having paired magnets oppositely positioned within a circular securing surface, and resilient tubes for frictionally engaging tees.

7 Claims, 2 Drawing Sheets

DEVICE FOR SECURING GOLF TEES AND BALL MARKS

RELATED APPLICATIONS

This application is a continuation-in-part of U.S. patent application Ser. No. 13/987,704 filed on Aug. 23, 2013 by the same inventor.

BACKGROUND OF THE INVENTION

1. Field of the Invention

This invention relates to the game of golf, and more particularly concerns a device for retrieving coin-shaped devices typically employed for marking the location of a golf ball, and for releasibly securing golf tees.

2. Description of the Prior Art

Devices for marking the location of a golf ball, generally referred to as "ball marks" are frequently emplaced and retrieved within a single game of golf. The ball marks are generally rigid circular discs bounded by opposed substantially flat surfaces, and having a diameter of about 25 mm and thickness of about 1.5 mm. They are generally fabricated of ferromagnetic material such as iron, and contain a protective coating which may include embossing, as in coinage. One or both surfaces generally contain decorative or informational indicia.

In order to minimize the annoyance of having to frequently deploy and retrieve a ball mark during a game, magnetic techniques have been disclosed whereby the ball mark can be attached to and released from a golf bag or article of clothing such as a cap. This requires the two-fold sequence of retrieving the ball mark by hand from the turf, and then storing it upon a securing substrate.

Most golfers still prefer to put the ball mark in their pant's pocket, and the pocket is often cluttered with other items. The retrieval of the ball mark from a pant's pocket is often challenging because of the small size of the ball mark and the sometimes tight-fitting pants usually preferred by women golfers.

A "fidgeting" hand manipulation has been known to sometimes relieve stress. This effect was made famous by the actor Humphrey Bogart in the classic film "The Caine Mutiny", where Bogart manipulated three steel balls in one hand. So, a ball mark securing device which permits a specialized or challenging movement via finger manipulation whether in or out of a golfer's pocket, could have special appeal to certain golfers.

The aforesaid indicia on the surfaces of the ball mark are generally intended to advertise products, organizations or institutions. Such feature of ball marks also cause them to be collectible items, especially when they may represent a significant golf tournament. Prior ball mark securing devices, especially those which cause the ball mark to magnetically attach to a substantially flat surface, prevent visual observation of both surfaces.

Golf tees are utilized to support a golf ball above the turf. The tee, generally fabricated of wood or plastic, has a length between 2⅛ and 4 inches, extending between a pointed lower extremity and a broadened top extremity of cup-shaped configuration. Several such tees are needed in the course of a game, and their storage and retrieval presents certain challenges. If placed in the golfer's pocket, the pointed extremity will damage the fabric of the pocket, and could cause retrieval difficulties by engaging said fabric upon upward lifting. Furthermore, loose tees can painfully jab the golfer's fingers.

It is accordingly an object of the present invention to provide a device for securing ball marks and tees, and specially suited for accommodation within a golfer's pants pocket.

It is a further object of this invention to provide a device of the aforesaid nature which can secure a ball mark in a manner to enable both surfaces of the ball mark to be seen.

It is another object of the present invention to provide a device of the aforesaid nature which, when confined within a golfer's pants pocket, will automatically attract and secure a ball mark entered into said pocket.

It is a still further object of this invention to provide a device of the aforesaid nature which enables a ball mark retained thereby to be manipulated in a challenging manner by the golfer's hand.

It is yet another object of the present invention to provide means which facilitate the insertion and removal of said device into and out of the golfer's pocket.

These objects and other objects and advantages of the invention will be apparent from the following description.

SUMMARY OF THE INVENTION

The above and other beneficial objects and advantages are accomplished in accordance with the present invention by a device for attracting and holding a circular ferromagnetic golf ball marker, and for holding several tees, said device comprising a substantially flat rigid frame elongated between a rounded forward extremity and rearward extremity, said frame having an aperture located adjacent said forward extremity and bounded by a circular side wall surface, a pair of diametrically positioned permanent magnets associated with said sidewall surface to produce moveable securement of a ball mark, and several receptacles in said rearward extremity for gripping tees. In a preferred embodiment, said frame is fabricated of plastic, and is symmetrically configured about a plane that orthogonally bisects said forward and rearward extremities. Said moveable securement is such as to permit three different modes of movement of the ball mark with respect to said frame. The present invention further embraces the combination of the aforesaid device with a ball mark secured within said aperture and two to four tees secured by said gripping receptacles.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
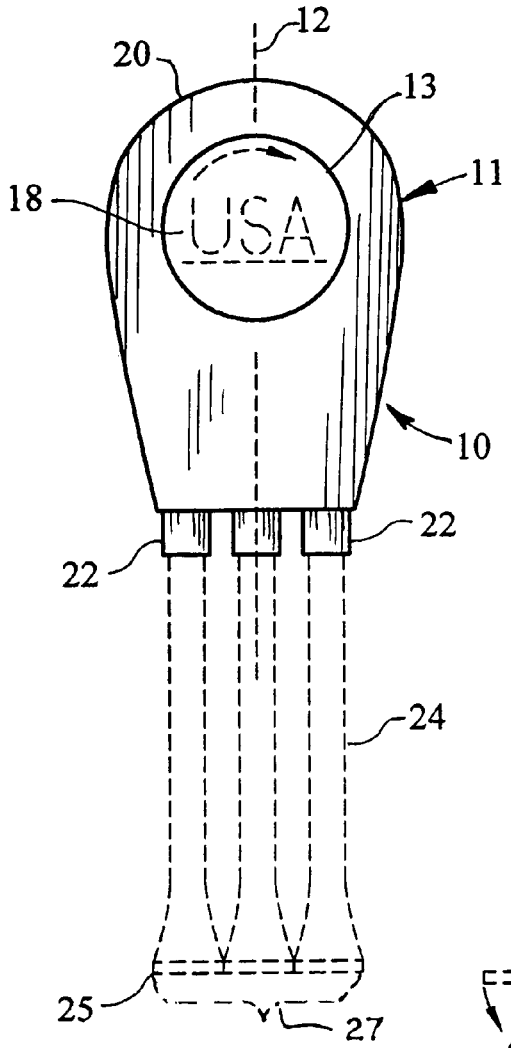
FIG. 1 is a plan view of an embodiment of the device of the present invention showing in phantom outline a functionally associated golf ball mark and golf tees, the opposite plan view being of substantially identical appearance.

Referring now to FIGS. 1-6, an embodiment of the device 10 of this invention is shown comprised of a substantially rigid frame 11 having a vertical plane of symmetry 12 and a circular aperture 13 having a sidewall securing surface 14. The frame is preferably fabricated of a hard or semi-rigid plastic, and may be a monolithic structure or a composite of two shaped halves bonded together. The thickness of the frame, measured between exterior surfaces 15 is preferably between 5 and 8 millimeters. The diameter of circular aperture 13 is between 22 and 27 millimeters. The maximum width of the frame, measured between opposite edges 16 is between 35 and 45 millimeters, and the length of the frame, measured between forward extremity 20 and rearward extremity 21 is preferably between 50 and 65 millimeters.

A pair of preferably identical permanent magnets 17 are embedded within frame 11 at locations which are diametrically opposed about securing surface 14. The magnets may be either fixed in place or permitted limited movement. Said magnets are of rare earth composition, wherein at least one magnet has a pull force of 1 to 4 pounds and a surface field of 6300 to 6800 gauss. The magnets may have a circular cylindrical rod-like configuration having a diameter in the range of about ⅛" to 3/16", and a length in the range of about ¼" to ⅜", causing the ratio of length to diameter to be preferably between 2/1 and 3/1. Magnets of other shapes, such as cubic and disc-shaped may also be employed having the aforesaid strength characteristics.

When cylindrical magnets are employed, they are emplaced such that their length axes are in parallel relationship. Suitable magnets are available from the K and J Magnetics Corporation of Jamison, Pa. The paired magnets, in concert, are preferably capable of lifting a ferromagnetic ball mark 18 a distance of 7 to 12 millimeters. Ball marks which are retrievable by the device of this invention have a circular diameter of about 25 millimeters and a weight between about 2 and 6 grams.

Figure 2:
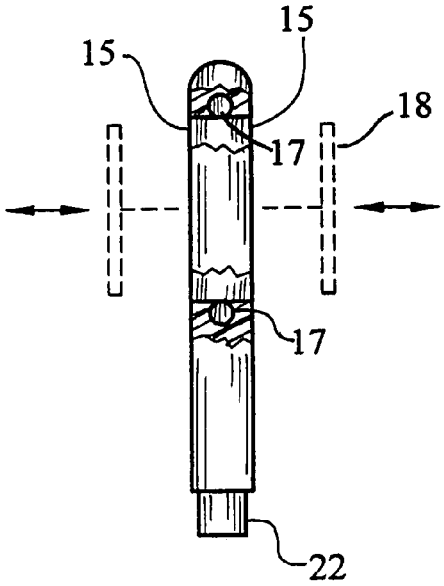
FIG. 2 is a right side view with portions broken away, the opposite side view being of identical appearance.
Figure 3:
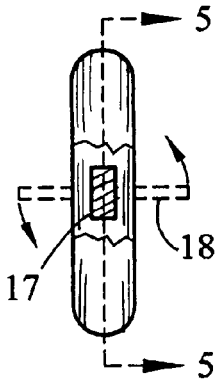
FIG. 3 is a top end view with a portion broken away.
Figure 4:
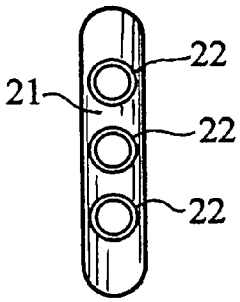
FIG. 4 is a bottom end view.
Figure 5:
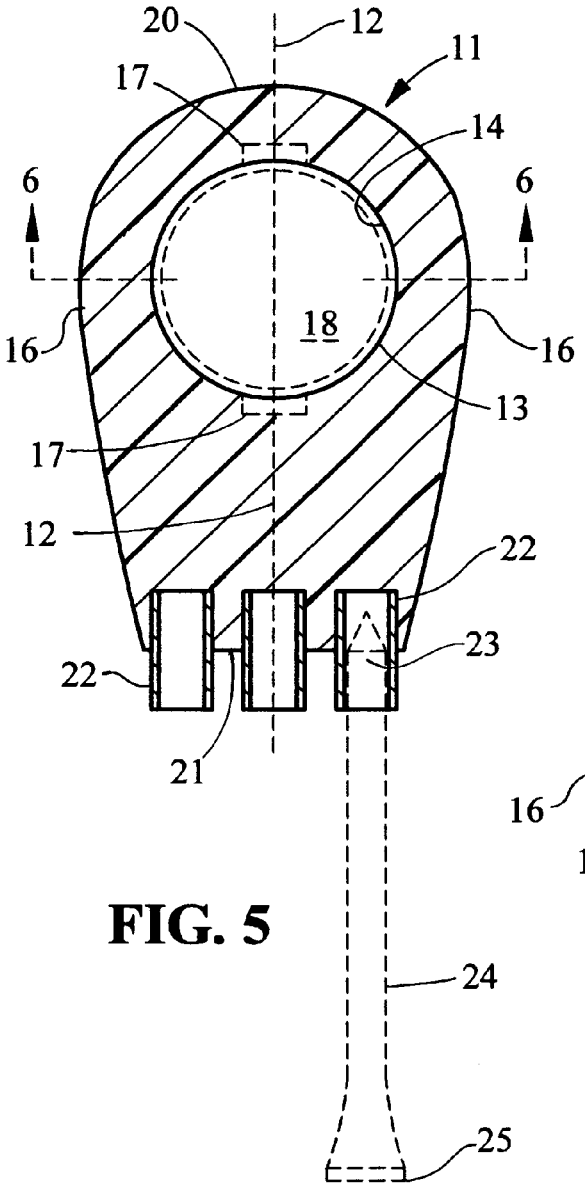
FIG. 5 is an enlarged sectional view taken in the direction of the arrows upon the line 5-5 of FIG. 3.
Figure 6:
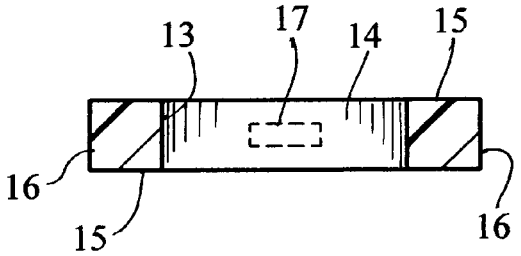
FIG. 6 is a sectional view taken in the direction of the arrows upon the line 6-6 of FIG. 5.

In operation, a ball mark engaged by securing surface 14 can be manipulated in three different ways. In a first mode of movement, as indicated by the arrowed phantom line in FIG. 1, the ball mark can revolve about its center on a path within the frame. In a second mode of movement, as indicated in FIG. 3, the ball mark may be rotated about an axis extending between paired magnets 17, whereby the path of rotation is orthogonal to frame 11. In a third mode of movement, as indicated in FIG. 2, the ball mark can be pulled outwardly away from engagement with the frame, then released, whereupon it will be pulled back into engagement with securing surface 14.

It has been found that, when having the aforesaid critically selected dimensions, frame 11 provides the further advantage of enabling the golfer to remove the device from the pocket of tight-fitting trousers.

Rearward extremity 21 is provided with receptacles 22 for receiving the pointed extremities 23 of tees 24. The exemplified receptacles are short lengths of a resilient plastic tubing which secures the tee by frictional interaction. Other gripping means capable of frictionally securing the tees may however, be employed. In a preferred embodiment, three such receptacles are employed in equally spaced relationship. Said receptacles may be completely housed within frame 11 or may protrude rearwardly therefrom. When the pointed extremities 23 are properly inserted into said receptacles, the associated heads 25 of the tees, having a cup-shaped contour, will lie in coplanar relationship. In a preferred embodiment, heads 25 are in lateral abutment, generating a unifying buttressing effect that forms a manipulating handle 27. When the device is placed in the golfer's pocket with frame 11 downwardly directed, it is easily removable merely by grasping the handle-like tee structure.

Such configuration also permits the tees to be grasped as a manipulating handle that enables the device to be used as a toy wherein the golfer can, with one hand throw ball markers several feet vertically, and with the other hand manipulating the device to catch the falling ball mark within securing circle 14.

In a still further unexpected utilization, the interactive tees can function to serve as legs which enable the device to stand upright unaidedly upon a flat surface such as a desk. When utilized as an item of desk equipment, the upstanding device, with suitably selected ball mark, can display to a visiting person messages which might be known to be appreciated by that person. Examples of messages which might evoke favorable response are: "Republican"; "Democrat"; "Save the Animals"; "Abolish guns"; "Protect gun rights"; "Pro Choice"; "Pro Life"; "U.S. Army"; "U.S. Navy"; etc.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for attracting and holding a circular ferromagnetic golf ball marker, and for holding several tees, said device comprising a substantially flat rigid frame elongated between a rounded forward extremity and rearward extremity, said frame having an aperture located adjacent said forward extremity and bounded by a circular side wall surface, a pair of diametrically positioned permanent magnets associated with said sidewall surface to produce moveable securement of a ball mark, and several receptacles in said rearward extremity for gripping tees, wherein said frame is fabricated of plastic, and is symmetrically configured about a plane that orthogonally bisects said forward and rearward extremities, and having two to four receptacles, and wherein said moveable securement of a ball mark permits three different modes of movement of the ball mark with respect to said frame.

2. The device of claim 1 further including a ferromagnetic golf ball marker held by said circular side wall surface, and golf tees gripped by said receptacles.

3. The device of claim 2 wherein the head extremities of said gripped tees are in lateral abutment, producing a unifying buttressing effect that enables such interactive tees to be grasped as a manipulating handle.

4. The device of claim 1 wherein said aperture has a diameter between 22 and 27 millimeters.

5. The device of claim 4 wherein said frame has a length, measured between said forward and rearward extremities, between 50 and 65 millimeters.

6. The device of claim 1 wherein said tees each have a pointed extremity and opposite head extremity of cup-shaped contour.

7. The device of claim 1 wherein said receptacles are short lengths of a resilient plastic tubing that receive the pointed extremity of each tee.

* * * * *